United States Patent [19]

Jamin

[11] 4,002,046

[45] Jan. 11, 1977

[54] TEXTILE PRINTING APPARATUS

[75] Inventor: Guillaume Ward Jamin, Manchester, England

[73] Assignee: Imperial Chemical Industries Limited, London, England

[22] Filed: Oct. 14, 1975

[21] Appl. No.: 622,157

[30] Foreign Application Priority Data

Oct. 23, 1974 United Kingdom ..... 45841/74
Oct. 23, 1974 United Kingdom ..... 45842/74

[52] U.S. Cl. ..... 68/5 C; 8/2.5 A; 38/25; 38/43; 68/200; 100/93 P; 100/264; 101/382 MV; 101/470; 156/583; 269/21

[51] Int. Cl.[2] ..... B41C 1/06; B25B 11/00; B30B 15/34; D06P 5/20

[58] Field of Search ..... 8/2.5, 2.5 A; 68/5 C; 100/93 P, 264; 156/583; 101/470, 382 MV; 38/25–28, 30, 43; 269/21, 22

[56] References Cited

UNITED STATES PATENTS

| | | | |
|---|---|---|---|
| 2,239,619 | 4/1941 | Morgatroyd et al. | 101/115 |
| 2,380,509 | 7/1945 | Emerson | 269/21 |
| 2,730,281 | 1/1956 | Prohaska | 100/93 P |
| 3,389,654 | 6/1968 | Hirt | 101/35 |
| 3,433,699 | 3/1969 | Rumble | 269/22 |
| 3,512,756 | 5/1970 | Cleland | 269/22 |
| 3,539,416 | 11/1970 | Sanders et al. | 156/583 |
| 3,568,754 | 3/1971 | Geiger | 269/22 |
| 3,682,748 | 8/1972 | Kimball | 156/583 |
| 3,949,574 | 4/1976 | Glover | 101/470 |

FOREIGN PATENTS OR APPLICATIONS

| | | | |
|---|---|---|---|
| 774,855 | 5/1970 | Belgium | 8/2.5 A |
| 2,313,006 | 9/1973 | Germany | 68/5 C |
| 1,405,457 | 9/1975 | United Kingdom | 101/470 |

OTHER PUBLICATIONS

Def. Pub., No. T939001, filed 10–72, Clark, et al.

*Primary Examiner*—Clyde I. Coughenour
*Attorney, Agent, or Firm*—Cushman, Darby & Cushman

[57] ABSTRACT

An apparatus for effecting the coloration of synthetic textile materials, at a reduced pressure, by a transfer process which comprises a pair of opposed rigid platens mounted for relative movement towards and away from each other, means for heating at least one of said platens to a temperature above 100° C, means for enclosing at least a portion of the space between the opposed surfaces of said platens when the platens have been moved towards each other into a closed position and means for reducing the pressure, within said portion, when the platens are in closed position, to below 100 mm of mercury, one of said platens being supported from at least one flexible diaphragm which is supported and sealed at its edges, the space on the side of the diaphragm from which the platen is supported being connected to the gas tight region between the platens whereby relative motion between the platens is effected by the differential pressure that is established across the diaphragm when the pressure in the gas tight region is reduced.

4 Claims, 2 Drawing Figures

TEXTILE PRINTING APPARATUS

This invention relates to an improved apparatus for effecting the transfer printing at reduced pressure of thick textile materials, more especially carpets having a pile of synthetic fibres especially polyamide and aromatic polyester fibres.

According to the present invention I provide an apparatus, for effecting the colouration of synthetic textile materials, at a reduced pressure, by a transfer process, which comprises a pair of opposed rigid platens mounted for relative movement towards and away from each other, means for heating at least one of said platens to a temperature above 100° C, means for enclosing at least a portion of the space between the opposed surfaces of said platens when the platens have been moved towards each other into a closed position and means for reducing the pressure, within said portion, when the platens are in said closed position, to below 100 mm of mercury, one of said platens being supported from at least one flexible diaphragm which is supported and sealed at its edges, the space on the side of the diaphragm from which the platen is supported being connected to the gas tight region between the platens whereby relative motion between the platens is effected by the differential pressure that is established across the diaphragm when the pressure in the gas tight region is reduced.

The platens are preferably mounted on one above the other so that their opposed surfaces lie in horizontal planes. It is also preferred that the lower platen is evenly supported on more than one flexible diaphragm, more preferably four such diaphragms.

In a preferred from of the apparatus each of the flexible diaphragms takes the form of the diaphragm of a rolling diaphragm air cylinder from the piston of which the lower platen is supported.

The rolling diaphragm air cylinder has a very low inertia and a very low coefficient of friction so that only a very small pressure difference is required to set it in motion.

A particularly suitable form of rolling diaphragm air cylinder is manufactured by the Bellofram Corporation and described in UK Patent Specification No. 855348.

Alternatively each of the flexible diaphragms may take the form of a flat flexible sheet of a resilient material such as a natural or synthetic rubber which is supported across the centre of a double domed vessel, said sheet being distorted towards the shape of the domes when distended in one direction or the other. The platen is then preferably supported from a metal plate set at the centre of such a flexible sheet.

The space on the opposite side of each diaphragm from that to which the platen is attached may be connected to a common enclosure in which the pressure may be raised to above or lowered to below normal atmospheric pressure in order to vary the upward pressure on the lower platen.

The apparatus may conveniently take the form of a chamber the side walls of which have an inwardly projecting upper lip, the upper platen resting on a flexible sealing strip fixed to the upper surface of this lip. The upper platen is also provided with lifting means so that a piece of textile material may be placed within the chamber so as to rest on the lower platen. The lower platen is supported within the chamber and mounted on vertical rods each of which is supported from the piston of a rolling diaphragm air cylinder which is set in the base of the chamber or from the centre of a flat flexible sheet which is set in a double domed vessel that is formed in the base of the chamber.

On reducing the pressure within the chamber the upper platen is pulled down against the sealing strip and the lower platen is pressed upwardly towards the upper platen by movement of the pistons of the rolling diaphragm air cylinders, or distension of the flexible sheets, due to the differential pressure set up thereacross.

An apparatus which is a preferred embodiment of the invention will now be described, by way of example only, with reference to FIG. 1 of the accompanying drawing which represents a vertical section through the apparatus.

Figure 1:
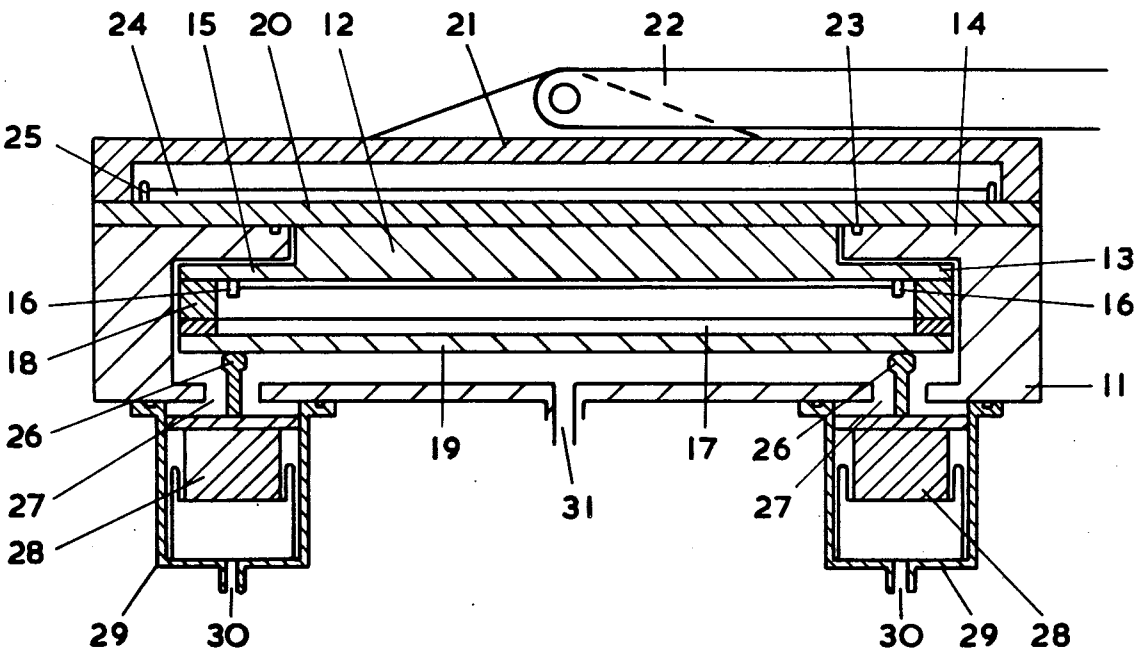
FIG. 1 shows one embodiment of the invention with piston actuation.

In FIG. 1 a chamber 11 has an open top into which loosely fits a square stepped metal platen 12 so that it can move up and down within the chamber 11. The step 13 protrudes under a lip 14 around the top of the chamber 11 and prevents the platen 12 moving above a position when its upper surface is flush with the flat top of the lip 14. The lower surface of the platen 12 carries a heater 15 attached by insulators 16. The platen 12 is suported from a rigid metal frame 17 on spacers 18 and the frame 17 rests on a sheet of insulating material 19.

An upper square metal platen 20 is attached to a domed cover 21 which is supported from a hinged arm 22 so that the upper platen 20 and cover 21 can be raised from and lowered onto the top of the chamber 11. In the lowered position it forms an air tight cover to the chamber, the seal being provided by a silicone rubber O ring 23 which sits in a groove cut in the upper surface of the lip 14. A second heater 24 is attached to the top side of the upper platen 20 under the domed cover 21 by means of insulators 25.

The lower platen assembly, i.e. the stepped platen 12, spacers 18, frame 17 and insulating sheet 19, rests on the upper ends of four vertical rods 26 (only two shown) each of which passes through a hole 27 in the base of the chamber 11 and is attached to its lower end to the top side of the piston 28 of a rolling diaphragm air cylinder 29 which is joined to the underside of the chamber 11 completely sealing the hole 27. The cylinder 29 below the piston 28 is connected by means of a pipe 30 to a source of air (not shown) the pressure of which can be varied.

The inside of the chamber 11 is connected to a source of vacuum (not shown) by a tube 31.

In operating the apparatus described above the heaters are switched on to raise the platens 12 and 20 to their working temperature. The upper platen 20 and cover 21 are raised by means of the arm 22 and a piece of textile material the same size as the hole in the top of the chamber 11 is placed on top of the stepped platen 12 with the side to be printed uppermost. This is overlaid with a piece of a carrier material with printed side downwards. The upper platen 20 is then lowered onto the top of the chamber 11 where it rests on the O ring 23. The chamber 11 is connected to the source of vacuum and the pressure within the chamber is reduced to not greater than 100 mm. of mercury. The low pressure causes the upper platen 20 to be held firmly against the top of the chamber 11 and also causes the pistons 28 of the rolling diaphragm air cylinders 29 to move towards the chamber 11 thus raising the stepped platen 12. Thus the textile and carrier material are held firmly in contact between the two platens 12 and 20 the contact pressure being dependent on the pressure difference across the rolling diaphragm air cylinders. The pressure difference can be varied by applying air pressure to the air cylinders 29 (the same pressure being supplied to each cylinder at any one time) via the pipes 30.

For any particular textile material air above, at or below atmospheric pressure is selected for application to the lower side of the pistons to obtain the derived contact pressure between the textile material and the carrier material, a single setting of air pressure supplied to the air cylinders 29 then sufficing to produce the same contact pressure between the textile material and the carrier material for varying thicknesses of the textile material.

Figure 2:
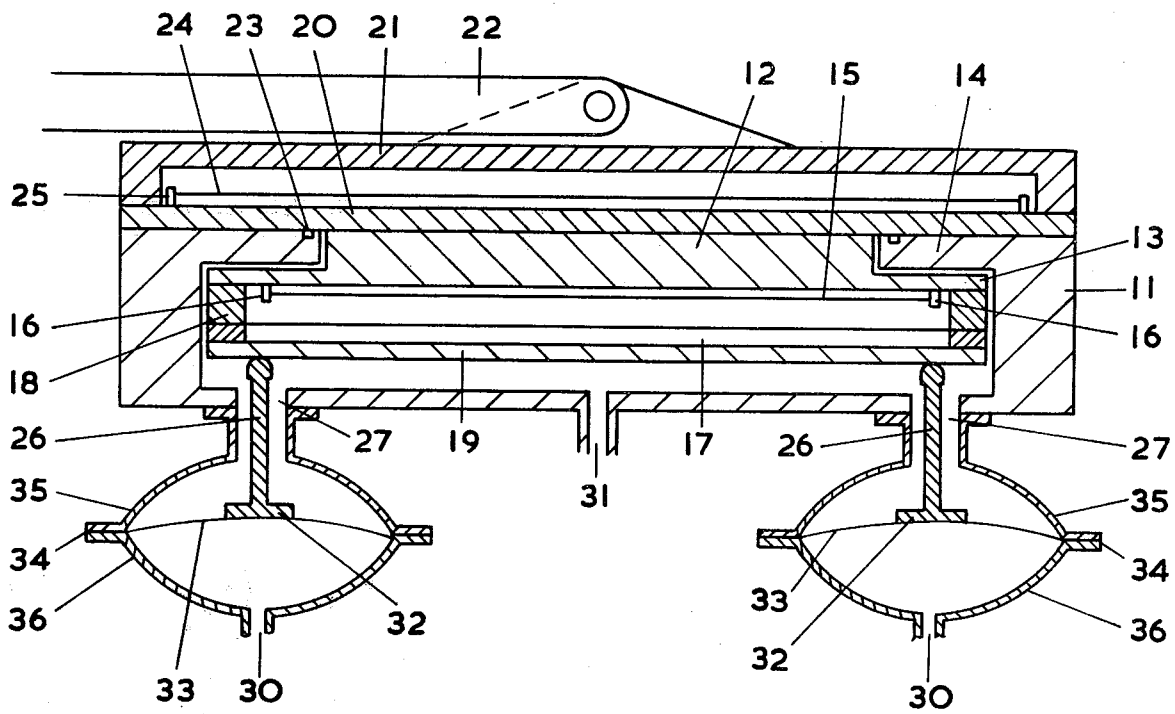
FIG. 2 shows another embodiment of the invention with diaphragm actuation.

An apparatus which is a further preferred embodiment of the invention will not be described, by way of example only, with reference to FIG. 2 of the accompanying drawing which represents a vertical section through the apparatus.

In FIG. 2 a chamber 11 has an open top into which loosely fits a square stepped metal platen 12 so that it can move up and down within the chamber 11. The step 13 protrudes under a lip 14 around the top of the chamber 11 and prevents the platen 12 moving above a position when its upper surface is flush with the flat top of the lip 14. The lower surface of the platen 12 carries a heater 15 attached by insulators 16. The platen 12 supported from a rigid metal frame 17 on spacers 18 and the frame 17 rests on a sheet of insulatng material 19.

An upper square metal platen 20 is attached to a domed cover 21 which is supported from a hinged arm 22 so that the upper platen 20 and cover 21 can be raised from and lowered onto the top of the chamber 11. In the lowered position it forms an air tight cover to the chamber the seal being provided by a silicone rubber O ring 23 which sits in a groove cut in the upper surface of the lip 14. A second heater 24 is attached to the top side of the upper platen 20 under the domed cover 21 by means of insulators 25.

The lower platen assembly, i.e. the stepped platen 12, spacers 18, frame 17 insulating sheet 19, rests on the upper ends of the four vertical rods 26 (only two shown) each of which passes through a hole 27 in the base of the chamber 11 and is attached to a rigid plate 32 which forms the centre portion of a flexible air impermeable diaphragm 33 that divides a subsidiary chamber 34 into two portions. The upper portion 35 above the diaphragm opens directly into the chamber 11 and the lower portion 36 is connected to a source of air (not shown) the pressure of which can be varied.

The inside of the chamber 11 is connected to a source of vacuum (not shown) by a tube 31.

In operating the apparatus described above the heaters are switched on to raise the platens 12 and 20 to their working temperature. The upper platen 20 and cover 21 are raised by means of the arm 22 and a piece of textile material the same size as the hole in the top of the chamber 11 is placed on top of the stepped platen 12 with the side to be printed uppermost. This is overlaid with a piece of a carrier material with printed side downwards. The upper platen 20 is then lowered onto the top of the chamber 11 where it rests on the O ring 23. The chamber 11 is connected to the source of vacuum and pressure within the chamber is reduced to not greater than 100 mm. of mercury. The low pressure causes the upper platen 20 to be held firmly against the top of the chamber 11 and also causes the flexible diaphragm 33 and the central plates 32 to which the rods 26 are attached to move upwards towards the chamber 11 thus raising the stepped platen 12. Thus the textile and carrier material are held firmly in contact between the two platens 12 and 20 to the contact pressure being dependant on the pressure difference across the flexible diaphragm. The pressure difference across the diaphrams 33 can be varied by applying varying air pressures to the lower portions 36 of each subsidiary chamber 34 the same pressure being applied to each subsidiary chamber 30 at any one time via the pipes 30.

For any particular textile material air above, at or below atmospheric pressure is selected for application to the lower side of the diaphragms to obtain the desired contact pressure between the textile material and the carrier material, a single setting of the air pressure supplied to the lower side of the diaphragm 33 then sufficing to produce the same contact pressure between the textile material and the carrier material for varying thickness of the textile material.

I claim:

1. Apparatus for effecting the colouration of snythetic textile materials, at a reduced pressure, by a transfer process, which comprises a pair of opposed rigid platens mounted for relative movement towards and away from each other, means for heating at least one of said platens to a temperatre above 100° C, means for enclosing at least a portion of the space between the opposed surfaces of said platens when the platens have been moved towards each other into a closed position and means for reducing the pressure, within said portion, when the platens are in said closed position, to below 100 mm of mercury, at least one rolling diaphragm air cylinder assembly having a cylinder, a piston within the cylinder and a flexible rolling diaphragm sealed at its periphery to the inside of said cylinder, said diaphragm being connected to said piston and forming an annular fold or roll which resides between a portion of the piston and the sidewall of the cylinder, one of said platens being supported from the piston of said rolling diaphragm air cylinder assembly, the space on the side of said rolling diaphragm from which the platens is supported being connected to the gas tight region between the platens whereby relative motion between the platens is effected by the differential pressure that is established across said rolling diaphragm when the pressure in the gas tight region is reduced.

2. Apparatus according to claim 1 in which the platens are mounted one above the other.

3. Apparatus according to claim 2 in which the lower platen is supported from the pistons of more than one rolling diaphragm air cylinder assembly.

4. Apparatus according to claim 3 in which the lower platen is supported from the pistons of four rolling diaphragm air cylinder assemblies.

* * * * *